US007168506B2

(12) United States Patent
Boucher et al.

(10) Patent No.: US 7,168,506 B2
(45) Date of Patent: Jan. 30, 2007

(54) ON-BIT, ANALOG MULTIPLEXER FOR TRANSMISSION OF MULTI-CHANNEL DRILLING INFORMATION

(75) Inventors: Marcel Boucher, Houston, TX (US); Aaron Schen, Houston, TX (US); Craig Ivie, Spring, TX (US); Brett Stanes, Houston, TX (US)

(73) Assignee: ReedHycalog, L.P., Houston, TX (US)

( * ) Notice: Subject to any disclaimer, the term of this patent is extended or adjusted under 35 U.S.C. 154(b) by 257 days.

(21) Appl. No.: 10/709,108

(22) Filed: Apr. 14, 2004

(65) Prior Publication Data

US 2005/0230149 A1 Oct. 20, 2005

(51) Int. Cl.
*E21B 17/10* (2006.01)

(52) U.S. Cl. ..... 175/48; 175/50

(58) Field of Classification Search ..... 175/39–50
See application file for complete search history.

(56) References Cited

U.S. PATENT DOCUMENTS

| | | | | |
|---|---|---|---|---|
| 3,707,700 | A | | 12/1972 | Lafont |
| 4,001,774 | A | * | 1/1977 | Dawson et al. ..... 340/854.6 |
| 4,033,186 | A | | 7/1977 | Bresie |
| 4,161,782 | A | | 7/1979 | McCracken |
| 4,227,404 | A | | 10/1980 | West |
| 4,227,405 | A | | 10/1980 | West |
| RE31,222 | E | | 4/1983 | McCracken |
| 4,409,824 | A | | 10/1983 | Salama et al. |
| 4,415,895 | A | | 11/1983 | Flagg |
| 4,434,971 | A | | 3/1984 | Cordrey |
| 4,459,760 | A | | 7/1984 | Watson et al. |
| 4,471,533 | A | * | 9/1984 | Van Steenwyk et al. ..... 33/302 |
| 4,507,735 | A | | 3/1985 | Moorehead et al. |
| 4,527,425 | A | | 7/1985 | Stockton |
| 4,556,884 | A | | 12/1985 | Howells et al. |
| 4,578,675 | A | | 3/1986 | MacLeod |
| 4,583,093 | A | | 4/1986 | Beals |
| 5,064,006 | A | | 11/1991 | Waters et al. |
| 5,133,417 | A | | 7/1992 | Rider |
| 5,230,387 | A | | 7/1993 | Waters et al. |
| 5,251,708 | A | | 10/1993 | Perry et al. |
| 5,273,122 | A | | 12/1993 | Henneuse |
| 5,278,758 | A | | 1/1994 | Perry et al. |
| 5,454,605 | A | | 10/1995 | Mott |
| 5,813,480 | A | | 9/1998 | Zaleski, Jr. et al. |
| 5,908,212 | A | | 6/1999 | Smith et al. |
| 6,026,915 | A | | 2/2000 | Smith et al. |
| 6,230,822 | B1 | | 5/2001 | Sullivan et al. |
| 6,550,321 | B1 | | 4/2003 | Patey et al. |

(Continued)

FOREIGN PATENT DOCUMENTS

| | | |
|---|---|---|
| EP | 0186328 | 7/1986 |

*Primary Examiner*—Frank S. Tsay
(74) *Attorney, Agent, or Firm*—Jeffery E. Daly; Williams, Morgan & Amerson, P.C.

(57) ABSTRACT

The invention includes, in its various aspects and embodiments, a method and apparatus for multiplexing data on-bit in a drilling operation. The apparatus comprises a bit; a plurality of transducers situated on the bit; and an analog multiplexer situated on the on the bit and capable of receiving the output of the transducers, multiplexing the received outputs, and transmitting the multiplexed outputs. The method comprises taking a plurality of measurements of at least one down-hole drilling condition at a bit of a drill string; generating a plurality of analog signals representative of the measurements; and multiplexing the analog signals at the bit.

33 Claims, 10 Drawing Sheets

U.S. PATENT DOCUMENTS 6,626,251 B1 9/2003 Sullivan et al.
6,670,880 B1 12/2003 Hall et al.
6,842,990 B2 1/2005 Taylor

* cited by examiner

ON-BIT, ANALOG MULTIPLEXER FOR TRANSMISSION OF MULTI-CHANNEL DRILLING INFORMATION

BACKGROUND OF INVENTION

1. Field of the Invention

The present invention pertains to drilling bits, and, more particularly, to instrumented drilling bits.

2. Description of the Related Art

As drilling technology matures and drilling operations become more complex, various types of sensors and other electronic components are being employed down-hole. Even drill bits, where the actual cutting occurs, are being equipped with electronics to improve or monitor their performance. Such bits are sometimes referred to as "instrumented bits." For example, pressure transducers can be placed on the bit in order to obtain an overall pressure pattern experienced during drilling. This information may indicate, for instance, whether bit balling occurs which can significantly downgrade a bit's performance during drilling operation. Usually several types of sensors are implemented on a bit so that different parameters can be measured simultaneously. This can result in a detailed measure of the bit's performance during drilling that can be transmitted up the drill string to either the surface or a sub-assembly for storage. The positions of these sensors on the bit may vary, but multiple wires from each transducer transmit information up the drill string. Conventionally, this was implemented using a multi-pin connector with strict size limitations. The size limitations also limited the number of wires that could be connected.

One approach to this problem is employs digital multiplexers and digital circuitry down-hole. The information is handled digitally because digital data is relatively high quality. Data converted to a digital stream is more immune to noise than is analog data because there are essentially only two states that the data can take on, 1 or 0; these states can be represented by easily discernable voltages such as 5V and 0 V for example (actual voltage levels depend on power supply requirements). It is much easier to retain the integrity of digital data that has only two possible values than data spanning over a continuous voltage range such as in an analog waveform.

On the other hand, an analog waveform traveling over one or more conductors for any significant distance (depending on environment, this distance may vary), will get noise coupled on top of that waveform and potentially corrupt the data being transferred. An application such as an acquisition tool with analog sensors will typically install analog-to-digital converters and digital multiplexers in very close proximity to the sensors. This ensures that the analog waveform does not have to travel very far before getting converted to digital format, hence minimizing the chance of picking up noise.

By installing sensors as close as possible to the cutters on a bit, one is able to more accurately measure various effects during drilling. But space is a premium when it comes to bit designs, and so one of the biggest challenges with an application "on-the-bit" is finding room to mount electronics and install conductors. There is a delicate balance between implementing as much circuit functionality as possible while retaining the design structure of the drill bit to ensure high quality drilling. Thus, the conventional approach to analog components in down-hole applications is fraught with difficulty when applied to bits since it adds an extra electronic component (the A/D converter) as well.

The present invention is directed to resolving, or at least reducing, one or all of the problems mentioned above.

SUMMARY OF INVENTION

The invention includes, in its various aspects and embodiments, a method and apparatus for multiplexing data on-bit in a drilling operation. The apparatus comprises a bit; a plurality of transducers situated on the bit; and an analog multiplexer situated on the on the bit and capable of receiving the output of the transducers, multiplexing the received outputs, and transmitting the multiplexed outputs. The method comprises taking a plurality of measurements of at least one down-hole drilling condition at a bit of a drill string; generating a plurality of analog signals representative of the measurements; and multiplexing the analog signals at the bit.

BRIEF DESCRIPTION OF DRAWINGS

The invention may be understood by reference to the following description taken in conjunction with the accompanying drawings, in which like reference numerals identify like elements.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers" specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
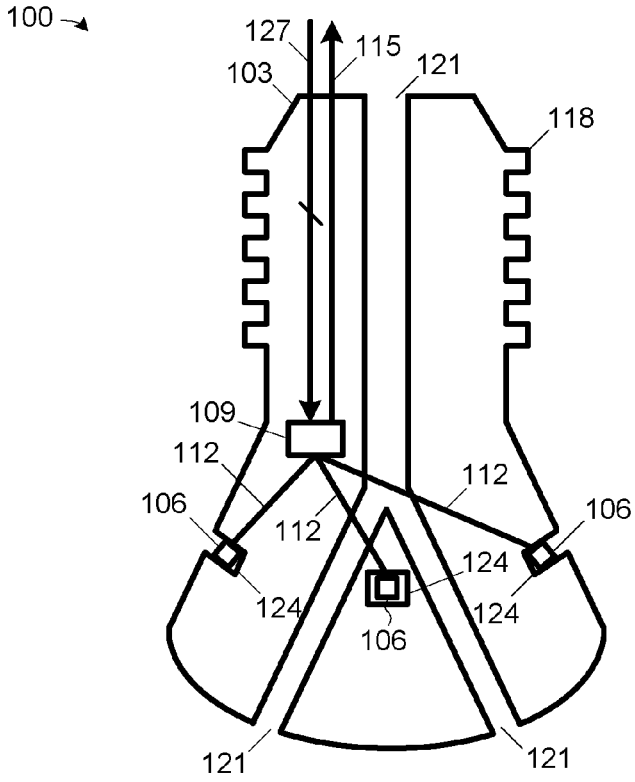
FIG. 1 illustrates a first embodiment of an instrumented drill bit in accordance with the present invention.

FIG. 1 conceptually illustrates an instrumented bit 100 constructed in accordance with the present invention. The instrumented bit 100 comprises a bit 103, a plurality of transducers 106, and an analog multiplexer 109. The transducers 106 and analog multiplexer 109 may be situated on the bit 103 in any suitable manner known to the art. In operation, the transducers 106 sense various conditions in the environment in which the bit 103 operates, and outputs analog electrical signals indicative of the sensed condition on the respective lines 112. The analog multiplexer 109 receives the outputs of the transducers 106 over the lines 112, multiplexes them, and transmits the multiplexed outputs over the line 115. Thus, the analog multiplexer 109 is capable of receiving the output of the transducers 106, multiplexing the received outputs, and transmitting the multiplexed outputs.

More particularly, the bit 103 may be any conventional bit known to the art. For example, the bit 103 may be a roller cone bit or a fixed cutter bit. The bit 103 includes a thread 118 by which the bit 103 may be joined to sections of drill pipe, subs, or tools (none of which are shown in FIG. 1) to comprise a portion of a drill string. The bit 103 defines a channel 121 extending therethrough and through which drilling fluids may be pumped in accordance with standard practices known to the art. The bit 103 also defines, in this particular embodiment, a plurality of "pockets" 124 in which the transducers 106 are situated in accordance with conventional practice.

The design, manufacture, and implementation of the thread 118, channel 121, and pockets 124 are all conventional and well known in the art. Conventional bits with which the bit 103 may be implemented in various embodiments routinely incorporate such features. These aspects of the bit 103 are also not material to the practice of the invention. Accordingly, so as not to obscure the present invention, they will not be discussed any further.

As mentioned above, the transducers 106 sense various conditions in the environment in which the bit 103 operates. These conditions may be, for example, associated with temperature, pressure, direction, stress, etc. The conditions of interest will be known to those in the art having the benefit of this disclosure and will be implementation specific. Thus, various alternative embodiments may employ different types of sensors. Exemplary types of sensors that may be employed in various embodiments include, but are not limited to, temperature transducers, strain gauges, accelerometers, pressure transducers, and directional transducers. In one particular embodiment, at least one of the transducers 106 is a wear sensor, which is not known to the art but is disclosed in co-pending U.S. Provisional Application Ser. No. 60/521,299, entitled "Wear Sensor", and filed on Mar. 29, 2004, in the name of the inventors Marcel Boucher, et al., and commonly assigned herewith. Note that some embodiments may employ a set of transducers 106 that are all of the same type, while others may "mix-and-match"different types of transducers 106.

Also as will be appreciated by those in the art having the benefit of this disclosure, the number and position of the transducers 106 will depend on the conditions to be sensed. Temperature sensors may be employed in different numbers and different locations from pressure sensors, for instance. The considerations as to number and placement of the transducers 106 as a function of the conditions they sense are well known in the art. Selection, number, and placement of the transducers 106 is therefore not material to the present invention, although they may be concerns in implementing individual embodiments. However, since these matters are well within the ordinary skill of the art, they are not further discussed so as to avoid obscuring the present invention.

The analog multiplexer 109, as mentioned above, receives the outputs of the transducers 106 over the lines 112, multiplexes them, and transmits the multiplexed outputs uphole over the line 115. The analog multiplexer 109 should be sufficiently rugged to withstand the rigors of operating in the relatively harsh environments encountered down-hole during drilling. Some commercially available, off-the-shelf analog multiplexers are available. One such analog multiplexer is the LTC1390, commercially available from:Linear Technology, Inc.

1080 W. Sam Houston Parkway, Suite 225 Houston, Tex. 77043Tel: 713-463-5001Fax: 713-463-5009Linear Technology may also be contacted through their website on the Internet. However, other analog multiplexers may be employed.

By multiplexing the outputs of the transducers 106, the present invention effectively reduces the number of leads, and therefore the number of connections, needed to carry the information to, for instance, the surface. In the illustrated embodiment, the analog multiplexer 109 multiplexes the outputs of three transducers 106 onto the single line 115. The illustrated embodiment therefore uses only a single conductor (i.e., the line 115) to transport data from multiple data sources (i.e., the transducers 106) to, for example, a subassembly (not shown) above the bit and, eventually, the surface. The illustrated embodiment realizes a three to one reduction in the number of lines and connections, although the scale of the reduction will be implementation specific.

Figure 2:
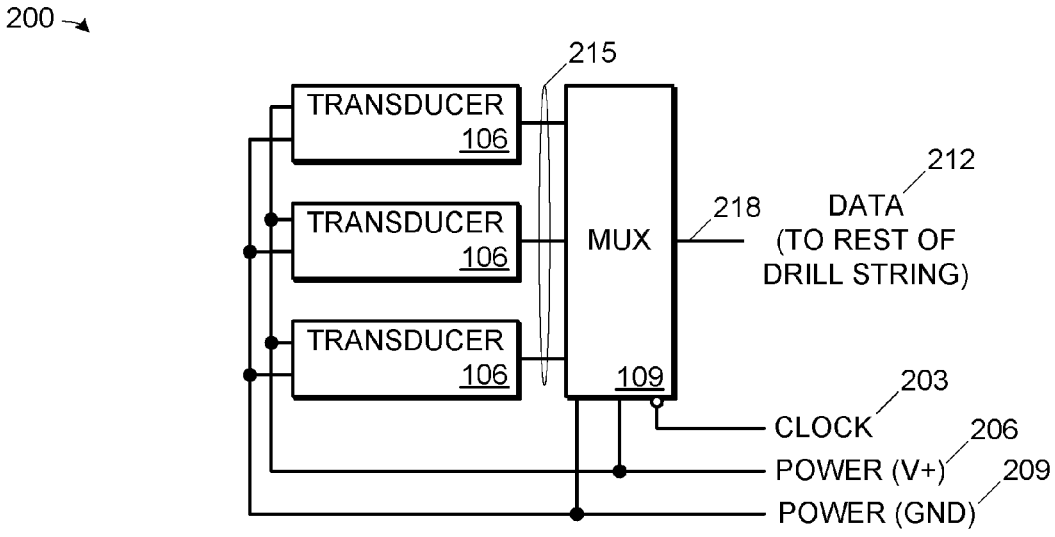
FIG. 2 is a circuit diagram of selected portions of the circuitry on the instrumented bit of FIG. 1.

The transducers 106 and the analog multiplexer 109 are wired together, as shown in FIG. 2, into an on-bit electrical circuit 200. Techniques for wiring electrical circuits on-bit are known to the art, and such techniques may be used to wire the circuit 200. Note that the circuit 200 includes a clock signal 203, a power (V+) signal 206, and a power (GND) signal 209 not shown in FIG. 1. These signals may be provided on-bit in a manner described more fully below, or may be transmitted directly to the instrumented bit 100, shown in FIG. 1, through the drill string (not shown). For instance, these signals may be transmitted to the instrumented bit 100 over the lines 127. In the illustrated embodiment, the analog multiplexer 109 changes state on the falling edge (not shown) of the clock signal 203. The analog multiplexer 109 and, hence, the circuit 200, transmits the data 212 up hole to the rest of the drill string (not shown).

Figure 3:
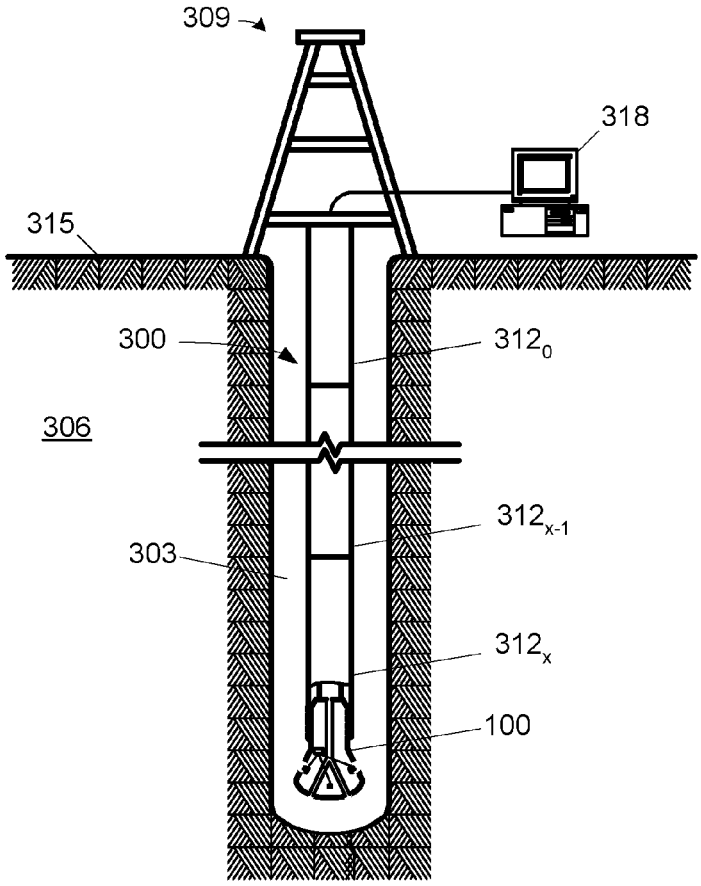
FIG. 3 illustrates a drill string including the instrumented bit of FIG. 1 in use.

FIG. 3 illustrates the instrumented bit 100 of FIG. 1 assembled into a drill string 300. The drill string 300 is suspended in a bore 303 in the ground 306 from equipment (not shown) aboard a drilling rig 309. The drill string 300 comprises, in addition to the instrumented bit 100, a plurality of sections 3120 312*x*, which may be variety of drill pipe sections, subassemblies, tools, etc. as are commonly known and used in the art. However, the section 312*x*, in this particular embodiment, is a down-hole tool designed to connect to the instrumented bit 100 in accordance with the present invention.

Figure 4:
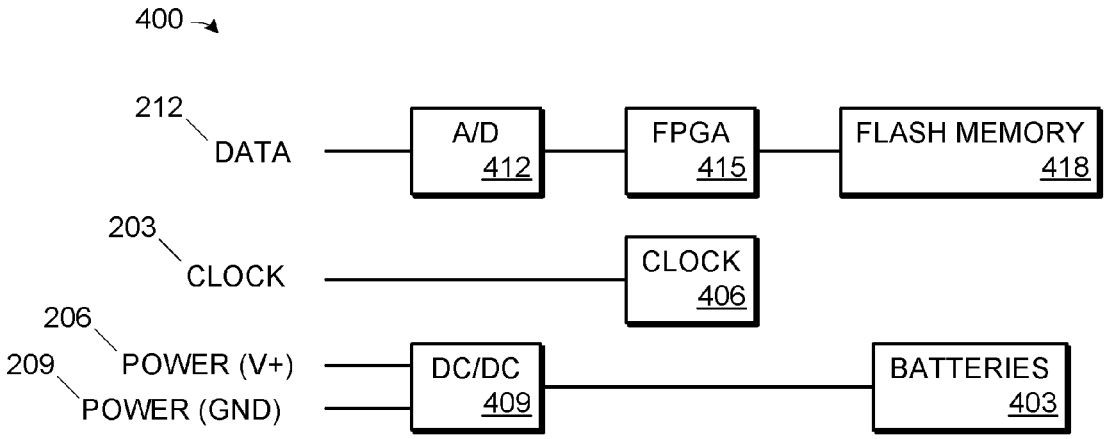
FIG. 4 is a circuit diagram of selected portions of the circuitry of a down-hole tool above the instrumented bit of FIG. 1 in the drill string of FIG. 3.

The section 312*x* includes, as is shown in FIG. 4, a circuit 400. The circuit 400 comprises a battery pack 403 generating the power (V+) and power (GND) signals 206, 209 and a clock circuit 406 generating the clock signal 203, the signals 203, 206, 209 being provided to the circuit 200, shown in FIG. 2, as described above. Note that, in this particular implementation, the power from the battery pack 403 passes through a DC/DC converter 409 to step the voltage down from that produced by the battery pack 403 to that consumed by the components of the circuit 200. Analog data from the instrumented bit 100 is converted to digital by the analog-to-digital ("A/D") converter 412, processed by the field programmable gate array ("FPGA") 415, and stored in the flash memory 418. Note that the circuit 400 admits variation in its implementation. For instance, the FPGA 415 could be replaced with, for example, a digital signal processor ("DSP") and the flash memory 418 may be replaced by some other kind of storage.

The sampling rate for the multiplexer 109, shown in FIG. 1 and FIG. 2, is chosen according to the desired frequency content to be retained in the data, and the sampling is carried out by the multiplexer 109 driven by a CLOCK timing signal 203. At each falling edge of the CLOCK timing signal 203, the multiplexer 109 samples an analog channel from one of the transducers 106 on one of its inputs 215. The data sampled on the inputs 215 is combined into a serial stream and presented at the output 218 of the multiplexer 109. The serial stream of data produced on the multiplexer output 218 is then transmitted up the bit 103 and into the drill string 300, shown in FIG. 3, via a single conductor. If desired, an analog de-multiplexer (not shown) of the same type may be implemented within the drill string 300 to split the data back out into parallel.

Returning to FIG. 3, the data 212, first shown in FIG. 2, is either stored down-hole until the drill string 300 is tripped to the surface 315, or it is transmitted to the surface 315 during drilling operations. In the illustrated embodiment, the data is stored down-hole. If transmitted to the surface 315, the data 212 will typically be transmitted to a computing apparatus 318. The computing apparatus 318 may store the data 212 and/or analyze it to determine whether it is desirable to change drilling conditions to meet drilling goals. Such an analysis may be performed contemporaneously or at some later time. If the data 212 is stored, it can be archived. In some embodiments, the data 212 may even be transported offsite, whether by satellite communication, transmission over a network connection (to, e.g., the Internet), or transport on a storage medium (e.g., a floppy disk).

Thus, the present invention provides an instrumented bit (e.g., the instrumented bit 100, of FIG. 1) in which the circuit designer can cut out a whole analog-to-digital conversion stage by not converting the analog waveform to digital format prior to multiplexing. This will result in fewer wire traces and fewer chips needed, thereby reducing the overall footprint of the circuit design. The emphasis is to save critical design space by keeping as much circuitry away from the cutting structure of the bit and more concentrated in the bit body, and analog multiplexers allow this to a greater degree than do digital multiplexers.

However, by keeping the data in analog format there is some risk of noise interference as discussed above. This noise corruption can be kept in check using a separate analog filter contained in the pre-processing stage prior to multiplexing in some embodiments. If so desired, the analog multiplexed signal can also be run through an analog-to-digital ("A/D") converter before being transmitted from the bit. This promises better noise immunity for the transmitted data signal and prepares the signal for a digital communication interface with sub-assembly tools. Some embodiments may also choose to filter prior to A/D conversion to help suppress noise. An integrated filter and A/D converter may be used without significant increase in space relative to an A/D converter.

Thus, the present invention admits some degree of variation in implementation. Consider, for instance, the instrumented bit 500, shown in FIG. 5. The instrumented bit 500 differs from the instrumented bit 110, shown in FIG. 1, in at least three ways. First, the instrumented bit 500 employs a sufficient number of transducers 503 distributed about the bit 506 that a plurality of multiplexers 509 are employed. Although this doubles the number of lines 512 on which the multiplexers 509 output data, it still reduces the number of lines on which the data would otherwise be sent up hole by a factor of three to one. Second, the instrumented bit 500 includes some power and timing circuitry 515, which is now on-bit, as opposed to in an up hole tool. This reduces the three lines on which the clock signal 203, power (V+) signal 206, and power (GND) signal 209, first shown in FIG. 2, in the instrumented bit 100, shown in FIG. 1, to a single line 518. Third, the instrumented bit 500 includes a plurality of filters 521 to mitigate aliasing effects that may arise from the multiplexer sampling process.

Some types of transducers 503 will not need filters because the sampling by the multiplexers 509 will not introduce aliasing effects in their output. For instance, the output of temperature sensors, accelerometers, and wear sensors may not need to be filtered. Furthermore, some types of sensors whose output may need filtering may include such filters a priori, thereby eliminating the need for additional filters such as the filters 521. Conversely, filters 521 may be employed even where not necessarily technically desirable to reduce such aliasing effects. Thus, the inclusion of the filters 521 to prevent aliasing effects will be implementation specific. However, the absence of filters such as the filters 521 will increase the likelihood of data corruption resulting from noise. Data processing techniques are known to the art and are available for reducing data corruption from sources such as noise. Nevertheless, even where not necessary to prevent aliasing effects, most embodiments will choose to employ filters such as the filters 521 prior to multiplexing anyway. Where used, the filters 521 can be implemented using simple RC ("resistance-capacitance") circuits.

Figure 5:
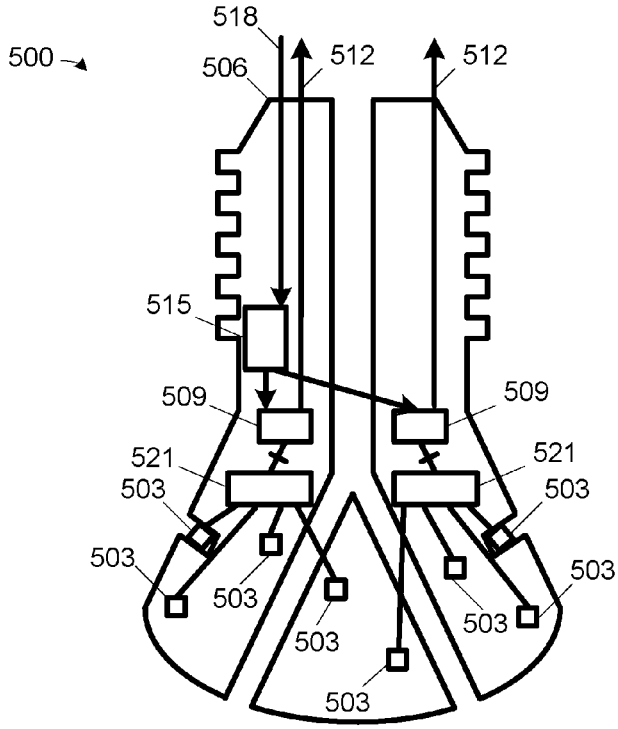
FIG. 5 FIG. 6 illustrate a second alternative embodiment of an instrumented bit in accordance with the present invention.
Figure 6:
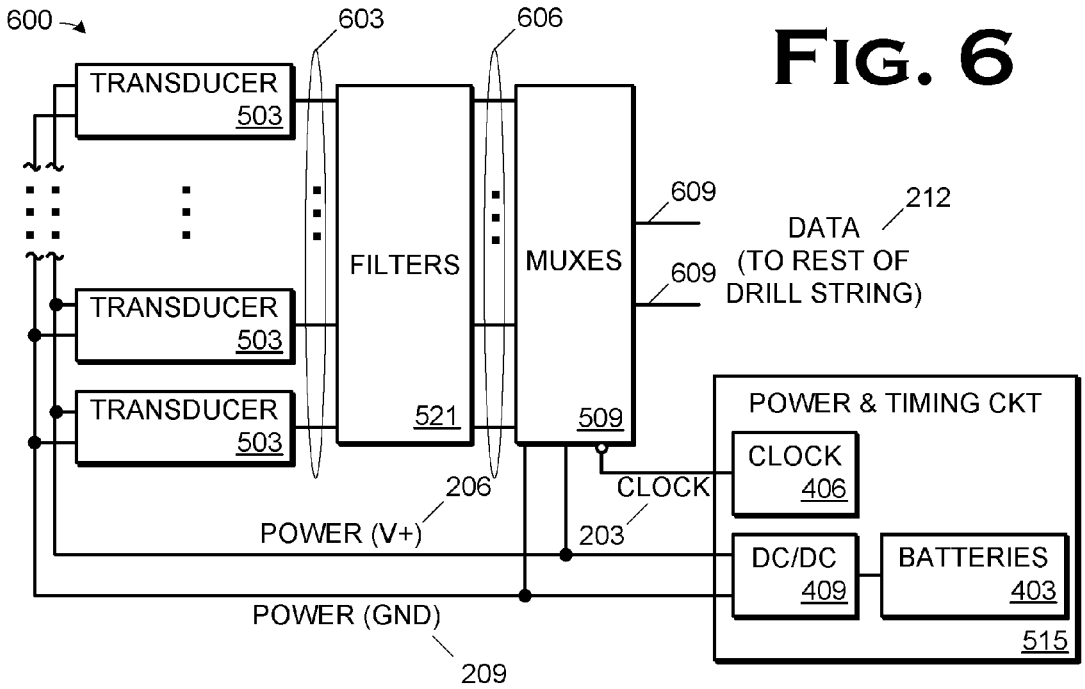

With respect to the embodiment of FIG. 5 and FIG. 6, more technically, a variety of sensors can be used to implement the transducers 503 and measure desired parameters of the performance of the bit 506. For example, the bit 506 might have eight sensors installed in pockets (not shown) machined within the body of the bit. Also, assume the bit 506 is a roller-cone bit, although the present invention can be used for both fixed-cutter and roller-cone bits. The transducers 503 can then be:

- three single axis accelerometers for measuring shocks (e.g., model 7290A by Endevco Corporation, 30700 Rancho Viejo Road, San Juan Capistrano, Calif. 92675, ph: 800-982-6732; fax: 949-661-7231).
- three temperature sensors for measuring bearing temperature (e.g., model RTD800 by OMEGA Engineering, Inc., One Omega Drive, Stamford, Conn. 06907-0047, P.O. Box 4047, ph: (800)-848-4286 or (203)-359-1660; fax: (203)-359-7700).

three strain gauges for measuring strain within the bit (e.g., TK-06-S111M-10C by Vishay Intertechnology, Inc., One Greenwich Place, Shelton, Conn. 06484, United States, ph:: 1-402-563-6866; Fax: 1-402-563-6296).

All these vendors also have sites through which they can be contacted and equipment purchased on the World Wide Web of the Internet. Note that other makes, manufactures, and types may be used in alternative embodiments.

The output 603 of each transducer 503 is fed into an analog, anti-aliasing filter 521 and then, in this particular implementation, into an amplification stage (not shown) that adds gain and offset to the sensor output signal to match the input voltage range of the multiplexer 509. The separate data signals 606 are then fed into an analog multiplexer 509, which successively samples these data lines with minimum time delay introduced. The filters 521 can be implemented using a simple RC circuit with a designed time constant that depends on overall desired frequency content to be retained in the data. Filtering prevents aliasing effects from occurring during the multiplexer sampling process and also to reduce unwanted noise. For example, to retain frequencies less than 400 Hz, the antialiasing filters 521 can be safely designed to have a 3 dB cutoff at 1 kHz.

The multiplexer sampling rate also satisfies the Nyquist rate. In the illustration above, to satisfy the Nyquist rate, the sampling rate exceeds 800 Hz. Accordingly, the sampling is performed the multiplexer 509 driven by a CLOCK timing signal 203 with a frequency greater than 800 Hz. The commercially available, eight-channel LTC1390 multiplexer, mentioned above, can be clocked at this frequency by a timing signal produced by a small crystal oscillator mounted either on the bit 506 or on a subassembly above the instrumented bit 500 (e.g., the section 312*x*), depending on whether a down-hole tool is present. At each trailing clock edge, the multiplexers 509 sample an analog channel on one of its inputs 603. The data sampled on the inputs 603 is concatenated into a serial stream and presented at the outputs 609 of the multiplexers 509. The serial stream of data produced on each multiplexer output 609 is then transmitted through the bit 506 via a single conductor.

Note that not all embodiments will necessarily include both the filters 521 and the power and timing circuitry 515, or either of those in conjunction with the additional multiplexers 509. Thus, in addition to the components of the instrumented bit 100 in FIG. 1, various alternative embodiments might use any one of, or any combination of, or all of:

- a filter capable of filtering the analog output of the transducers.
- a power circuit providing a power signal to at least one of the multiplexer and at least one of the transducers.
- a timing circuit capable of providing a timing signal to at least one of the multiplexer and at least one of the transducers.
- one or more additional mutliplexers.

Still other variations may become apparent to those skilled in the art having the benefit of this disclosure.

Figure 7A:
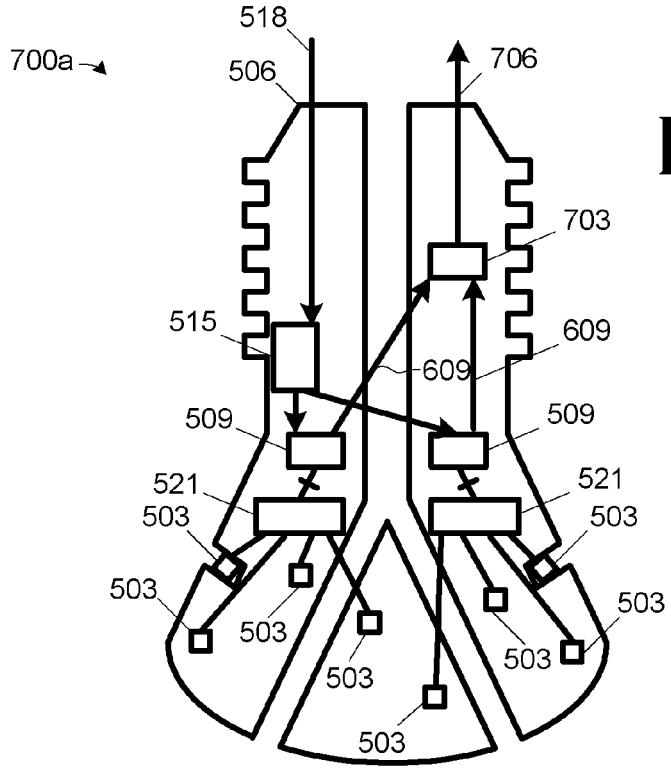
FIG. 7A–FIG. 7D illustrate several alternative embodiments of an instrumented bit in accordance with the present invention.

As was previously mentioned, it is generally desirable to reduce the number of connectors between the bit and the rest of the drill string. The instrumented bit 500 of FIG. 5 includes eight transducers 503 and two multiplexers 509. Each of the multiplexers 509 is, in the illustrated embodiment, a four-channel multiplexer. However, in alternative embodiments, the multiplexers 509 can be implemented with a commercially available, eight-channel multiplexer. Thus, in some embodiments, one of the multiplexers 509 can be eliminated by multiplexing the outputs 603, shown in FIG. 6, of all eight transducers 503 with the remaining multiplexer 509. Alternatively, the outputs of the multiplexers 509 may be also be multiplexed. FIG. 7A illustrates one such embodiment wherein the outputs 609 of the multiplexers 509 in an instrumented bit 700*a* are input to another multiplexer 703, multiplexed, and output so that the data is transmitted up hole on only a single line 706.

Figure 7B:
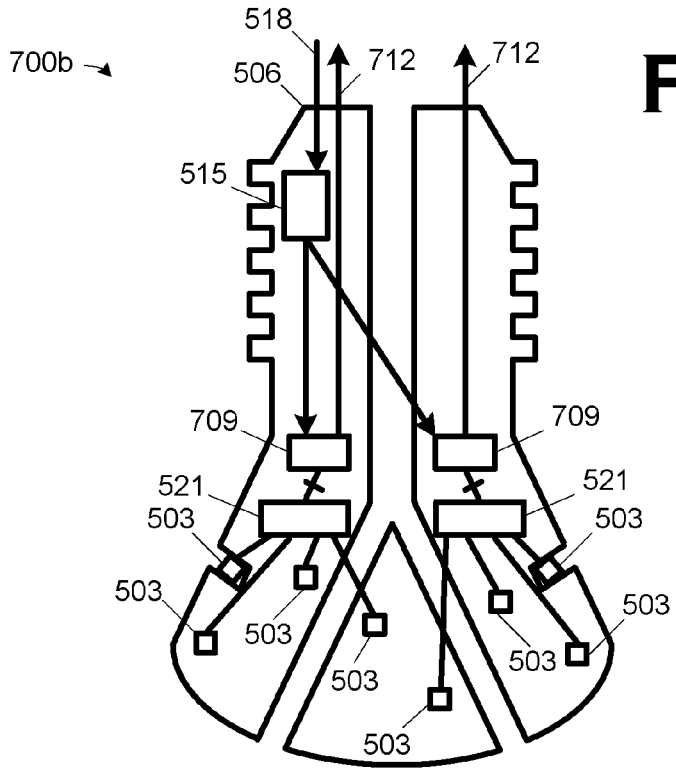

Also as was previously mentioned, it may be desirable to convert the data to a digital format in some embodiments even though not right at the transducers. In the instrumented bit 100 of FIG. 1, the A/D capability is performed by the A/D converter 412, shown in FIG. 4, of the section 312*x*, shown in FIG. 3, of the drill string 300. However, in some embodiments, the A/D capability may be mounted on-bit. FIG. 7B depicts an instrumented bit 700*b*, which substitutes integrated A/D converters and multiplexers 709 for the multiplexers 509 of the instrumented bit 500 in FIG. 5. The A/D converters perform the A/D conversion after the transducer outputs are multiplexed. Thus, the data stream on the lines 712 is digital, rather than analog.

Depending on the method of data retention or transmission, this data stream can be either transmitted into the drill string via very few conductors to a down-hole tool above the bit (i.e., a memory-mode tool) or across the pipe connection using inductive coils coupled together in close proximity (i.e., real-time transmission via intelligent drill pipe). The former option was discussed above relative to the embodiment of FIG. 1 FIG. 2 as used in the drill string of FIG. 3, with the selected portions of the electrical circuitry for the tool being shown in FIG. 4. The latter option will now disclosed.

Figure 7C:
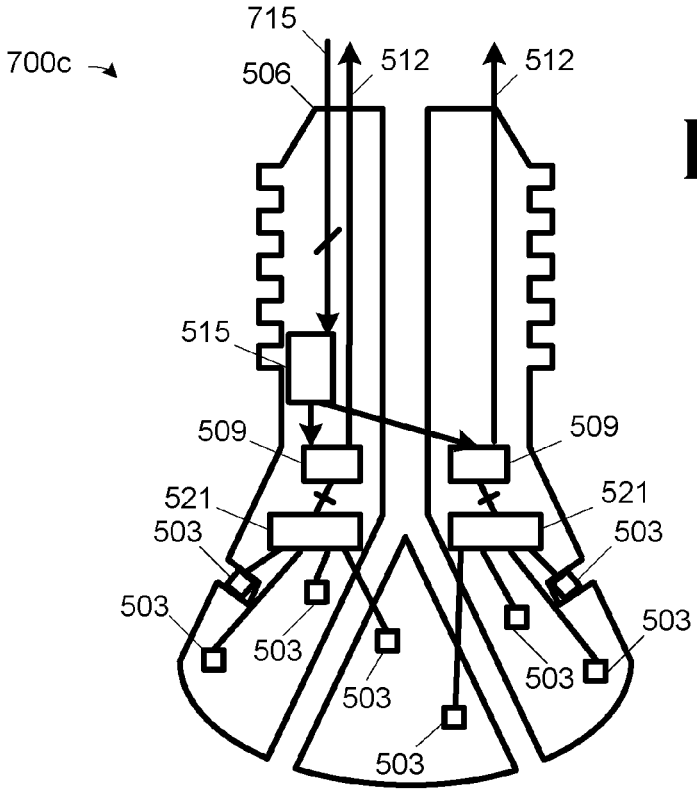

Note that, if a single wire 518 is used to draw power from batteries (e.g., the batteries 403 in FIG. 4) located in a sub above the bit 500, as is shown in FIG. 5, then this wire would correspond to V+. Since the bit 500 and the sub are essentially connected to the same ground plane (i.e., the earth being drilled through), an electrical ground wire can be omitted. However, technically, an electrical ground wire from the sub's battery ground to the ground of circuit 515 to the power circuitry 515 located on-bit would also be desirable, as shown in FIG. 7C. In this particular embodiment 700*c*, the wire 518 to the bit 500 in FIG. 5 has been replaced by the two wire bus 715, one wire being V+ and the other being an electrical ground.

Figure 7D:
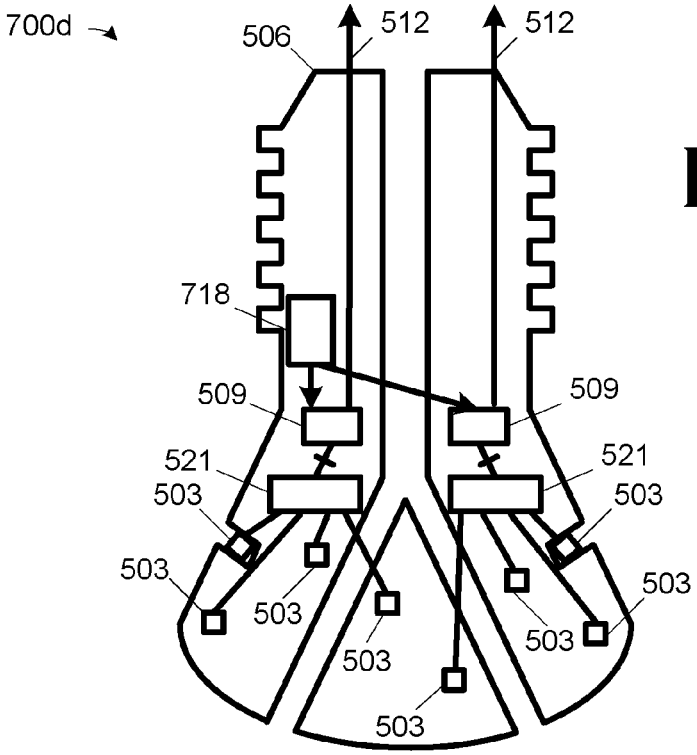

Some alternative embodiments may also employ standalone power and timing circuitry that does not receive power from a source off the bit. One such embodiment 700*d* is shown in FIG. 7D. For the instrumented bit 700*d*, the power source (i.e., batteries) is moved on-bit to the timing and power circuitry 718 rather than on an up-hole sub. Thus, the instrumented bit 700*d* eliminates the need for the wire 518 in FIG. 5 altogether, and further reduces the number of leads and electrical connections between the instrumented bit 700*d* and the rest of the drill string.

Figure 8:
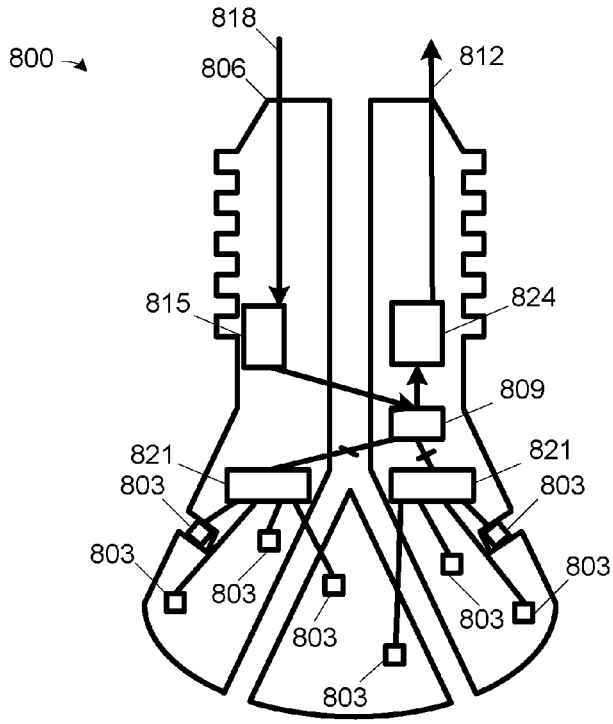
FIG. 8–FIG. 10 illustrate another alternative embodiment of an instrumented bit in accordance with the present invention.
Figure 9:
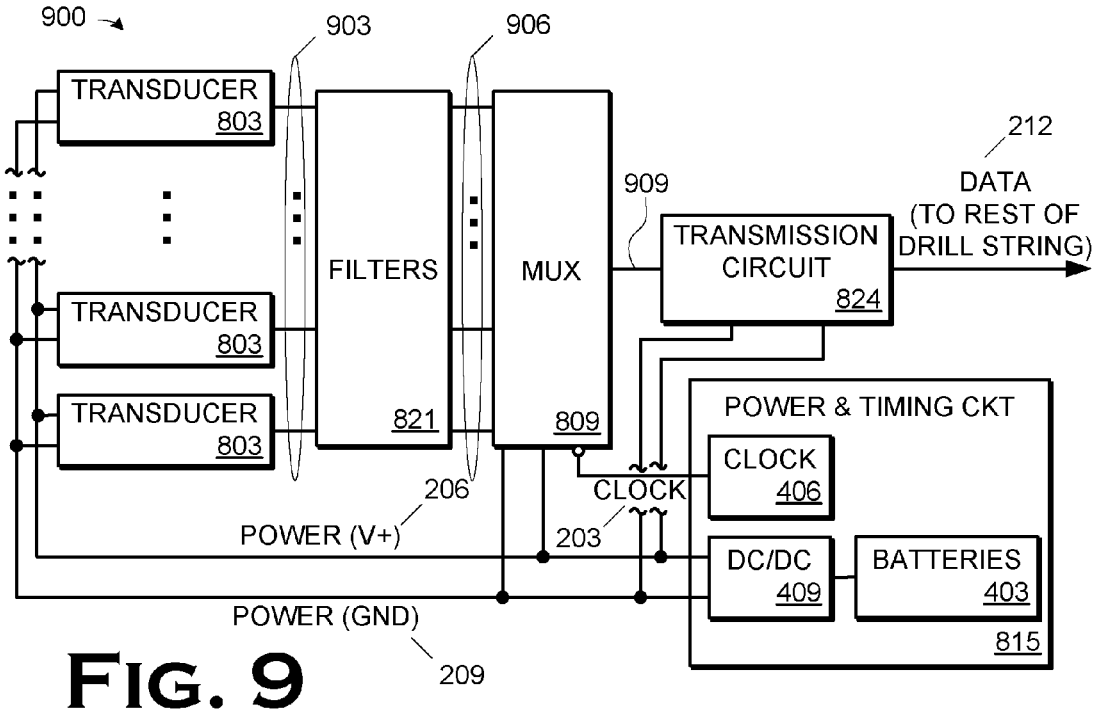

FIG. 8 FIG. 9 illustrate an instrumented bit 800 and the electronic circuit 900 thereon, respectively. The instrumented bit 800 includes a plurality of transducers 803 whose outputs are filtered by the filters 821 and multiplexed by the multiplexer 809 for transmission uphole, as was discussed above for other embodiments. The on-bit power and timing circuit 815 provides power and timing signals to the transducers 803, filters 821, and multiplexer 809, also in the manner discussed above for other embodiments. Note that, in this particular embodiment, the filtered outputs of all eight of the transducers 803 are multiplexed by the single multiplexer 809.

Figure 10:
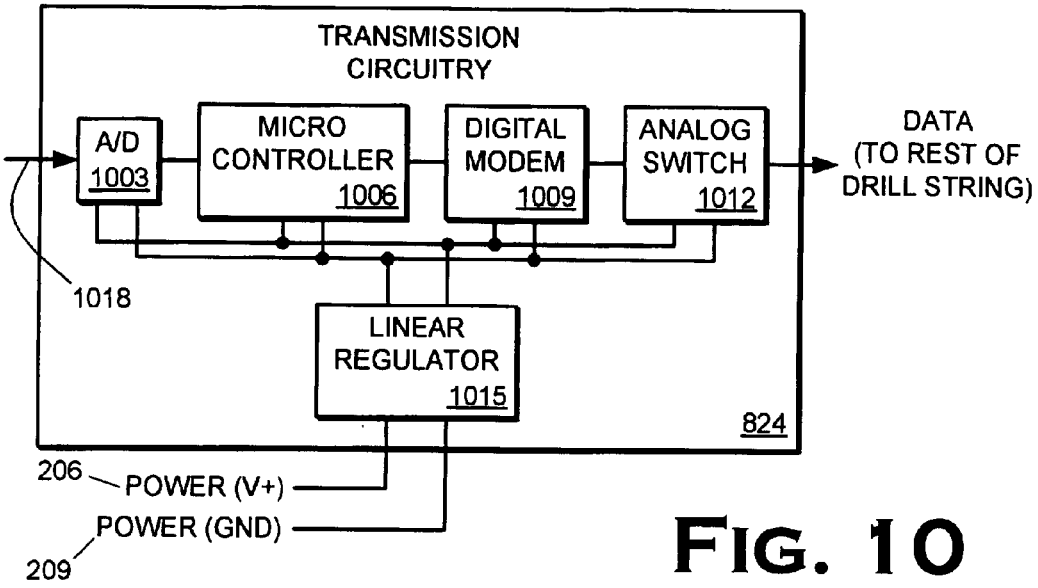

However, the instrumented bit 800 is intended for use in a drill string employing "intelligent", or "wired", drill pipe. The instrumented bit 800 therefore also includes transmission circuitry 824 that conditions the multiplexed data for transmission uphole. The transmission circuitry 824 is better illustrated in FIG. 10, and includes an A/D converter 1003, a micro-controller 1006, a digital modem 1009, and an analog switch 1012. Power signals POWER (V+) 206 and POWER (GND) 209 from the power and timing circuit 815 power these components through a linear regulator 1015.

More particularly, the analog multiplexed data 212, shown in FIG. 9, is received over the line 1018 and converted to digital by the A/D converter 1003. The microcontroller 1006 communicates with other down-hole acquisition systems (not shown) present in the drill string via RS232 interface. It receives and processes data received through the digital modem 1009 and from the instrumented bit 800, i.e., the data digitized by the A/D converter 1003. With respect to the digitized data, the microcontroller 1006 formats the outgoing data for transmission along the wired drill pipe (i.e., adds start/stop bits, checksum, etc).

The digital modem 1006 modulates the digital data, transmitted in packets, for transmission uphole in light of the inductive mechanism, illustrated in FIG. 12A FIG. 14B, and discussed further below, used in implementing the transmission path. The analog switch 1012 routes the digital, modulated data up the wired drill string. Note, however, that if the transmission circuitry were moved off-bit, the analog switch 1012 would be responsible for routing signals both up and down the drill string. In this particular embodiment, the signals might include, in addition to the modulated digital data originating from the transducers 803, shown in FIG. 8, data from sensors up and down the drill string. These signals might also include command and control signals to the instrumented bit 800 or other instrumented tools in the drill string.

Figure 11:
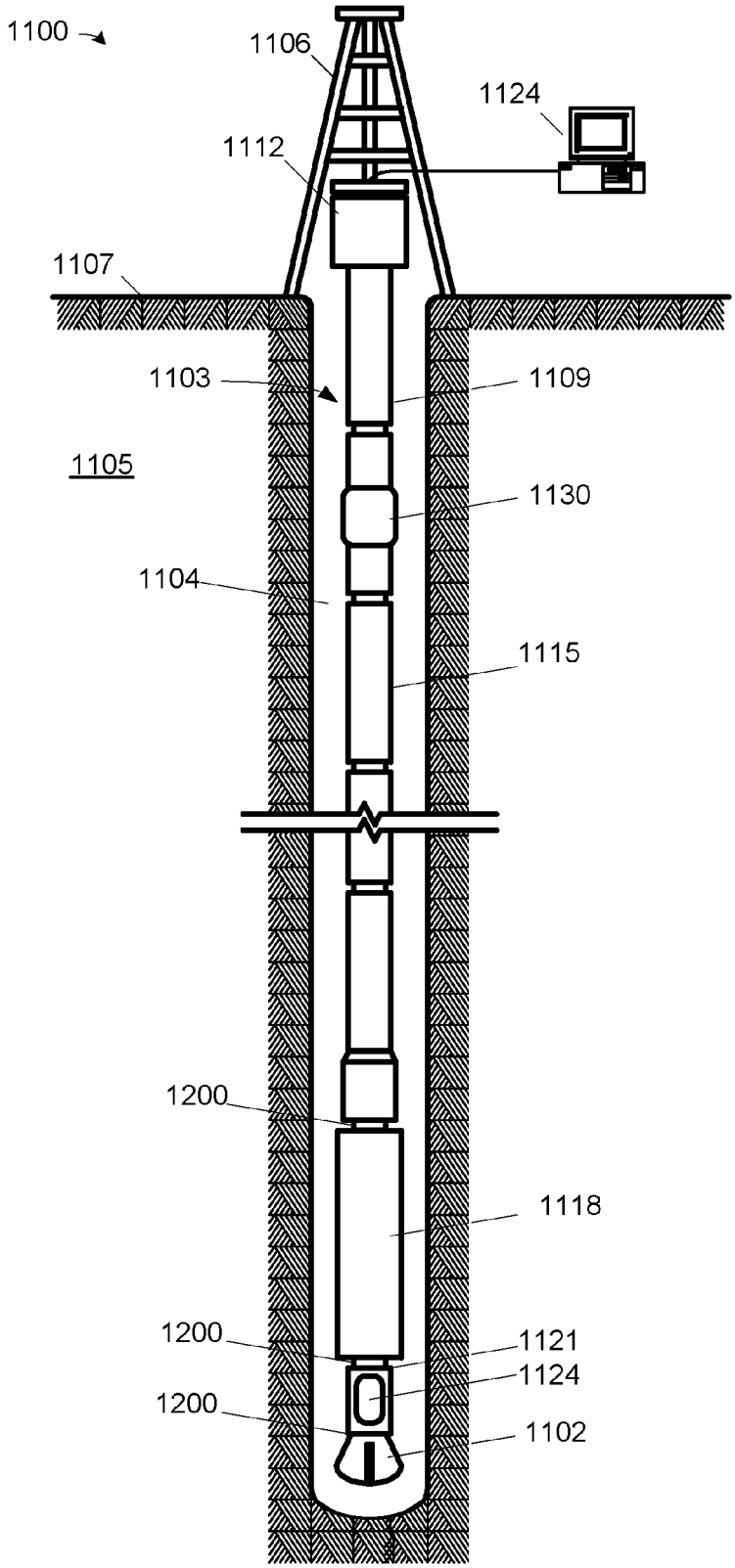
FIG. 11 conceptually illustrates a drilling operation employing the embodiment of FIG. 8 FIG. 10 down-hole in accordance with an embodiment alternative to that shown in FIG. 3.

FIG. 11 schematically illustrates a drilling operation 1100 employing the instrumented bit 800, best shown in FIG. 8, comprising a portion of the drill string 1103. In the drilling operation 1100, a drill string 1103, including the instrumented bit 800, is drilling a borehole 1104 in the ground 1105 beneath the surface 1107 thereof. In this particular embodiment, the drill string 1103 implements a "down-hole local area network," or "DLAN".

The drilling operation 1100 includes a rig 1106 from which the drill string 1103 is suspended through a kelly 1109. A data transceiver 1112 is fitted on top of the kelly 1109, which is, in turn, connected to a drill string 1103 comprised of a plurality of sections of drill pipe 1115 (only one indicated). Also within the drill string 1103 are tools (not indicated) such as jars and stabilizers. Drill collars (also not indicated) and heavyweight drill pipe 1118 are located near the bottom of the drill string 1103. A data and crossover sub 1121 is included just above the instrumented bit 800. The drill string 1103 interfaces with a computing apparatus 1124 through the kelly 1109 by means of a swivel, such as is known in the art.

The drill string 1103 will include a variety of instrumented tools for gathering information regarding down-hole drilling conditions. For instance, the instrumented bit 800 is connected to a data and crossover sub 1121 housing a sensor apparatus 1124 including an accelerometer (not shown). The accelerometer is useful for gathering real time data from the bottom of the hole. For example, the accelerometer can give a quantitative measure of bit vibration. The data and crossover sub 1121 includes a transmission path such as that described below for the sections 1300 in FIG. 13A FIG. 13C. So, too, do the instrumented bit 800 and the heavyweight drill pipe 1118.

Thus, many other types of data sources may and typically will be included aside from those on the instrumented bit 800. Exemplary measurements that may be of interest include hole temperature and pressure, salinity and pH of the drilling mud, magnetic declination and horizontal declination of the bottom-hole assembly, seismic look-ahead information about the surrounding formation, electrical resistivity of the formation, pore pressure of the formation, gamma ray characterization of the formation, and so forth.

To accommodate the transmission of the anticipated volume of data, the drill string 1103 will transmit data at a rate of at least 100 bits/second, and on up to at least 1,000,000 bits/second. However, signal attenuation is a concern. A typical length for a section of pipe (e.g., the section 1300 in FIG. 13A), is 30" 120". Drill strings in oil and gas production can extend as long as 20,000" 30,000", or longer, which means that as many as 700 sections of drill pipe, down hole tools, collars, subs, etc. can found in a drill string such as the drill string 1103. The transmission line created through the drill string by the pipe described above will typically transmit the information signal a distance of 1,000 to 2,000 feet before the signal is attenuated to the point where amplification will be desirable. Thus, amplifiers, or "repeaters," 1130 (only one shown) are provided for approximately for some of the components in the drill string 1103, for example, 5% of components not to exceed 10%, in the illustrated embodiment.

Such repeaters can be simple "dumb" repeaters that only increase the amplitude of the signal without any other modification. A simple amplifier, however, will also amplify any noise in the signal. Although the down-hole environment may be relatively free of electrical noise in the RF frequency range preferred by the illustrated embodiment, a "smart" repeater that detects any errors in the data stream and restores the signal, error free, while eliminating baseline noise, is preferred. Any of a number of known digital error correction schemes can be employed in a down-hole network incorporating a "smart" repeater.

The drill string 1103 comprises "wired pipe" that is, it includes a transmission path (not shown, but discussed further below) down its length. The present invention contemplates wide variation in the implementation of the transmission path under test. However, the transmission path of the illustrated embodiment, and reasonable variations thereon, are more fully disclosed and claimed in U.S. Pat. No. 6,670,880, entitled "Downhole Data Transmission System,"and issued Dec. 30, 2003, in the name of the inventors David R. Hall, et al.

Figure 12A:
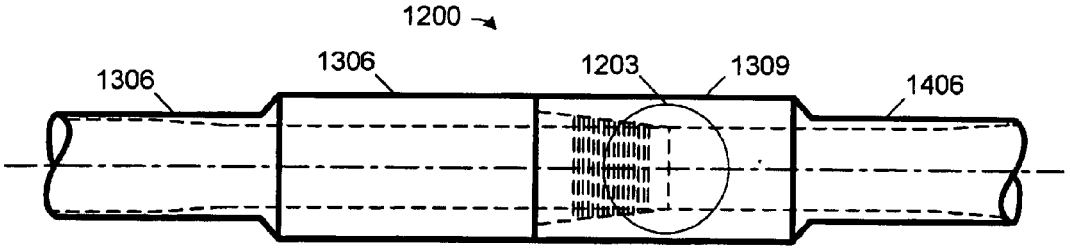
FIG. 12A–FIG. 12B depict an exemplary joint in the drill string of FIG. 11.
Figure 12B:
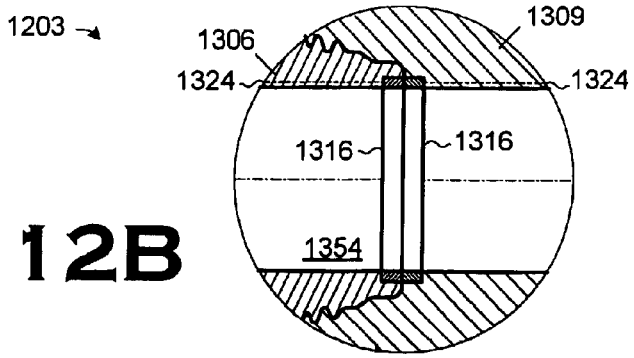
Figure 13A:
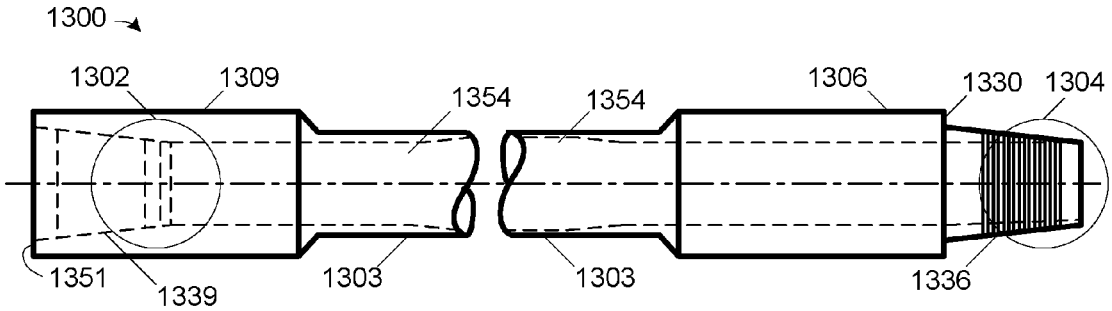
FIG. 13A–FIG. 13C illustrate one section of pipe, two of which are mated to form the joint of FIG. 12A FIG. 12B.
Figure 13B:
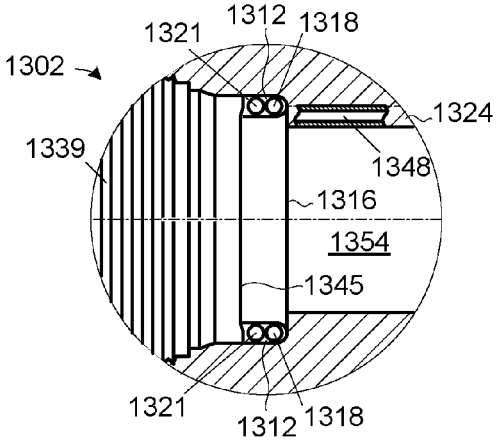
Figure 13C:
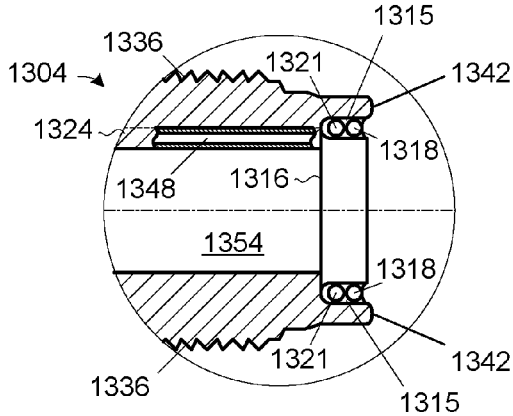

The joints 1200 (not all indicated) between these sections of the drill string 1103 comprise joints such as the joint 1200 best shown in FIG. 12A FIG. 12B. FIG. 12A is an enlarged view of the made up joint 1200 of FIG. 1. The two individual sections 1300 are best shown in FIG. 13A FIG. 13C. FIG. 12B is an enlarged view of a portion 1203 of view in FIG. 12A of the joint 1200. FIG. 13B FIG. 13C are enlarged views of a portion 1302 of a box end 1309 and a portion 1304 of the pin end 1306 of the section 1300 as shown in FIG. 13A.

As will be discussed further below, each section 1300 includes a transmission path that, when the two sections 1300 are mated as shown in FIG. 12A, aligns. When energized, the two transmission paths electromagnetically couple across the joint 1200 to create a single transmission path through the drill string 1103. The present invention is directed to testing the electromagnetic connectivity across joints in a drill string such as the joint 1200 and, hence, the transmission path in the drill string 1103. Various aspects of the particular transmission path of the illustrated embodiment are more particularly disclosed and claimed in the aforementioned U.S. Pat. No. 6,670,880. Pertinent portions of that patent are excerpted below. However, the present invention may be employed with other types of drill pipe and transmission systems.

Turning now to FIG. 13A, each section 1300 includes a tube body 1303 welded to an externally threaded pin end 1306 and an internally threaded box end 1309. Pin and box end designs for sections of drill pipe are well known to the art, and any suitable design may be used. Acceptable designs include those disclosed and claimed in:

U.S. Pat. No. 5,908,212, entitled "Ultra High Torque Double Shoulder Tool Joint", and issued Jun. 1, 1999, to Grant Prideco, Inc. of The Woodlands, Texas, as assignee of the inventors Smith, et al.

U.S. Pat. No. 5,454,605, entitled "Tool Joint Connection with Interlocking Wedge Threads", and issued Oct. 3, 1995, to Hydril Company of Houston, Tex., as assignee of the inventor Keith C. Mott.

However, other pin and box end designs may be employed.

Grooves 1312, 1315, best shown in FIG. 13B FIG. 13C, are provided in the respective tool joint 1200 as a means for housing electromagnetic couplers 1316, each comprising a pair of toroidal cores 1318, 1321 having magnetic permeability about which a radial or Archimedean coil (not shown) is wound. The groove 1315 is recessed into the secondary shoulder, or face, 1342 of the pin end 1306. The groove 1312 is recessed into the internal shoulder 1345. Additional information regarding the pin and box ends 1306, 1309, their manufacture, and placement is disclosed in the aforementioned U.S. Pat. No. 6,670,880. In the illustrated embodiment, the grooves 1315, 1312 are located so as to lie equidistant between the inner and outer diameter of the face 1342 and the shoulder 1345. Further, in this orientation, the grooves 1315, 1312 are located so as to be substantially aligned as the joint 1200 is made up.

Figure 14A:
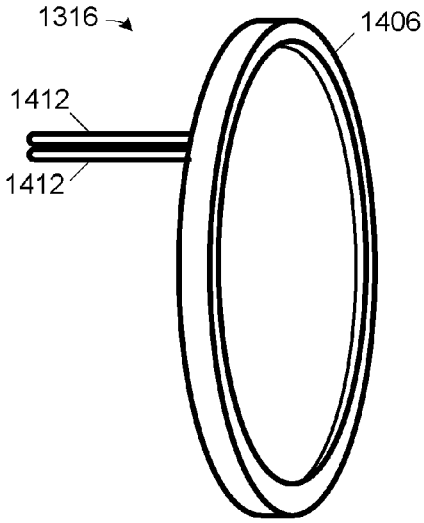
FIG. 14A–FIG. 14B illustrate an electromagnetic coupler of the section in FIG. 13A FIG. 13C in assembled and exploded views, respectively, that form a electromagnetic coupling in the joint of FIG. 12A FIG. 12B.
Figure 14B:
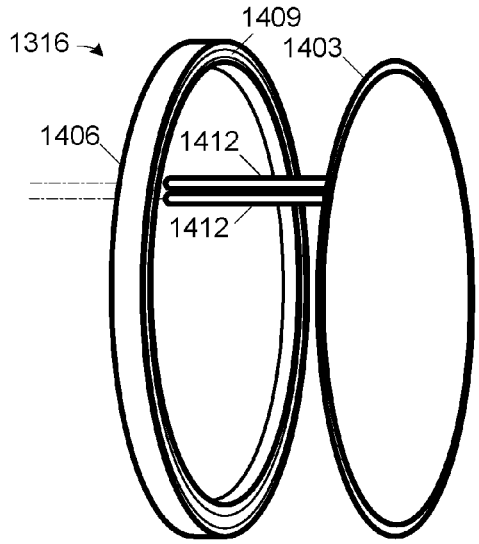

FIG. 14A–FIG. 14B illustrate an electromagnetic coupler 1316 in assembled and exploded views, respectively. Additional information regarding the construction and operation of the electromagnetic coupler 1316 in various alternative embodiments are disclosed in the aforementioned U.S. Pat. No. 6,670,880.

As previously mentioned, the electromagnetic coupler 1316 consists of an Archimedean coil, or planar, radially wound, annular coil 1403, inserted into a core 1406. The laminated and tape wound, or solid, core 1406 may be a metal or metal tape material having magnetic permeability, such as ferromagnetic materials, irons, powdered irons, ferrites, or composite ceramics, or a combination thereof. In some embodiments, the core material may even be a material without magnetic permeability such as a polymer, like polyvinyl chloride ("PVC"). More particularly, in the illustrated embodiment, the core 1406 comprises a magnetically conducting, electrically insulating ("MCEI") element. The annular coils 1403 may also be wound axially within the core material and may consist of one or more than one layers of coils 1403.

As can best be seen in the cross section in FIG. 14B, the core 1406 includes a U-shaped trough 1409. The dimensions of the core 1406 and the trough 1409 can be varied based on the following factors. First, the 1406 must be sized to fit within the grooves 1312, 1315. In addition, the height and width of the trough 1409 should be selected to optimize the magnetically conducting properties of the core 1406. Lying within the trough 1409 of the core 1406 is an electrically conductive coil 1403. This coil 1403 comprises at least one loop of an insulated wire (not otherwise shown), typically only a single loop. The wire may be copper and insulated with varnish, enamel, or a polymer. A tough, flexible polymer such as high density polyethylene or polymerized tetrafluoroethane ("PTFE") is particularly suitable for an insulator. The specific properties of the wire and the number of loops strongly influence the impedance of the coil 1403.

The coil 1403 is preferably embedded within a material (not shown) filling the trough 1409 of the core 1406. The material should be electrically insulating and resilient, the resilience adding further toughness to the core 1406. Standard commercial grade epoxies combined with a ceramic filler material, such as aluminum oxide, in proportions of about 50/50 percent suffice. The core 1406 is, in turn, embedding in a material (not shown) filling the groove 1312 or 1315. This second embedment material holds the core 1406 in place and forms a transition layer between the core 1406 and the steel of the pipe to protect the core 1406 from some of the forces seen by the steel during joint makeup and drilling. This resilient, embedment material may be a flexible polymer, such as a two-part, heat-curable, aircraft grade urethane. Voids or air pockets should also be avoided in this second embedment material, e.g., by centrifuging at between 2500 to 5000 rpm for about 0.5 to 3 minutes.

Returning to FIG. 13B FIG. 13C, a rounded groove 1324 is formed within the bore wall for conveying an insulated conductor means 1348 along the section 1300. The conductor means 1348 is attached within the groove 1324 and shielded from the abrasive drilling fluid. The conductor means 1348 may consist of wire strands or a coaxial cable. The conductor means 1348 is mechanically attached to each of the toroidal cores 1318, 1321 in a manner not shown. When installed into the grooves 1312, 1315, the electromagnetic couplers 1316 are potted in with an abrasion resistant material in order to protect them from drilling fluids (not shown).

An electrical conductor 1348, shown in FIG. 13B FIG. 13C, is connected between the coils 1403 at the box and pin ends 1306, 1309 of the section 1300. The electrical conductor 1348 is, in the illustrated embodiment, a coaxial cable with a characteristic impedance in the range of about 30 ohm–120 ohm, e.g., in the range of about 50 ohm–75 ohm. In the illustrated embodiment, the electrical conductor 1403 has a diameter of about 0.25" or larger.

However, other conductors (e.g., twisted wire pairs) may be employed in alternative embodiments.

The conductor loop represented by the coils 1403 and the electrical conductor 1348 is completely sealed and insulated from the pipe of the section 1300. The shield (not otherwise shown) should provide close to 100% coverage, and the core insulation should be made of a fully-dense polymer having low dielectric loss, e.g., from the family of polytetrafluoroethylene ("PTFE") resins, Dupont's Teflon® being one example. The insulating material (not otherwise shown) surrounding the shield should have high temperature resistance, high resistance to brine and chemicals used in drilling muds. PTFE is again preferred, or a linear aromatic, semi-crystalline, polyetheretherketone thermoplastic polymer manufactured by Victrex PLC under the trademark PEEKÒ. The electrical conductor 1348 is also coated with, for example, a polymeric material selected from the group consisting of natural or synthetic rubbers, epoxies, or urethanes, to provide additional protection for the electrical conductor 1348.

Referring now to FIG. 13A and FIG. 14A, as was mentioned above, the coil 1403 of the illustrated embodiment extends through the core 1406 to meet the electrical conductor 1348 at a point behind the core 1406. Typically, the input leads 1412 extend through not only the core 1406, but also holes (not shown) drilled in the grooves 1315, 1312 through the enlarged walls of the pin end 1306 and box end 1309, respectively, so that the holes open into the central bore 1354 of the pipe section 1300. The diameter of the hole will be determined by the thickness available in the section 1300 and the input leads 1412. For reasons of structural integrity it is preferably less than about one half of the wall thickness, with the holes typically having a diameter of about between 3 mm and 7 mm. The input leads 1412 may be sealed in the holes by, for example, urethane. The input leads 1412 are soldered to the electrical conductor 1348 to effect the electrical connection therebetween.

Returning to FIG. 12A, a pin end 1306 of a first section 1300 is shown mechanically attached to the box end 1309 of a second section 1300 by means of the mating threads 1336, 1339. The sections 1300 are screwed together until the external shoulders 1330, 1351 are compressed together forming the primary seal for the joint 1200 that prevents the loss of drilling fluid and bore pressure during drilling. When the joint 1200 is made up, it is preloaded to approximately one half of the torsional yield strength of the pipe, itself. The preload is dependent on the wall thickness and diameter of the pipe, and may be as high as 70,000 foot-pounds. The grooves 1312, 1315 should have rounded corners to reduce stress concentrations in the wall of the pipe.

When the pin and box ends 1306, 1309 of two sections 1300 are joined, the electromagnetic coupler 1316 of the pin end 1306 and the electromagnetic coupler 1316 of the box end 1309 are brought to at least close proximity. The coils 1403 of the electromagnetic couplers 1316, when energized, each produces a magnetic field that is focused toward the other due to the magnetic permeability of the core material. When the coils are in close proximity, they share their magnetic fields, resulting in electromagnetic coupling across the joint 1200. Although is not necessary for the electromagnetic couplers 1316 to contact each other for the coupling to occur, closer proximity yields a stronger coupling effect.

Thus, the drill strong 1103 is assembled, each joint 1200 between the various sections thereof magnetically coupling to create a transmission path the length of the drill string 1103 from the instrumented bit 800 to the surface 1107. In this particular embodiment, the instrumented bit 800 gathers the data and transmits it uphole to the computing apparatus 1124 at the surface 1107. Depending on the type of data collected by the transducers 803, the data may be presented to a user, analyzed, stored for later use, or some combination of these things.

Figure 15:
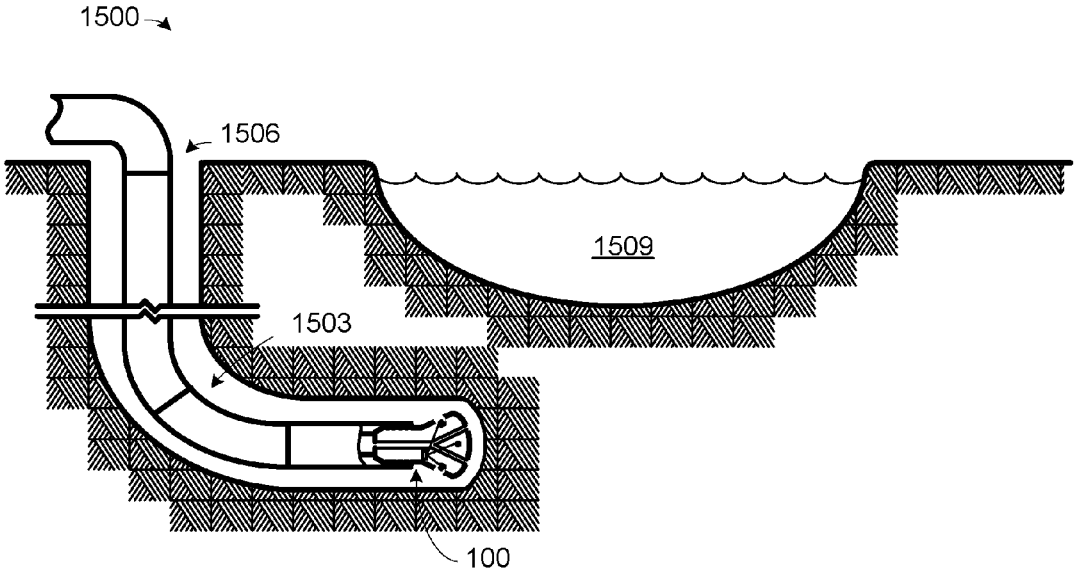
FIG. 15 illustrates a drilling operation in which the present invention is used in a directional drilling application, as opposed to the vertical drilling applications of FIG. 3 and FIG. 11.

As those in the art having the benefit of this disclosure will appreciate, the present in invention is not limited to instrumented bits used in vertical drilling or in drilling wells. FIG. 15 illustrates a directional drilling application 1500, in which an instrumented bit 100, first shown in FIG. 1 FIG. 2, comprises a portion of a drill string 1503. Note, however, that any of the embodiments disclosed herein may be used in such an application. In the illustrated embodiment, the drill string 1503 is being used to drill a bore 1506 under a water barrier 1509, although there are many other possible directional drilling scenarios. In the illustrated embodiment, the drill string 1503, aside from the instrumented bit 100, can be implemented in any conventional fashion known to the art.

The following patent and patent application are hereby incorporated by reference for all purposes as if expressly set forth verbatim herein:

U.S. Pat. No. 6,670,880, entitled "Down-hole Data Transmission System,"and issued Dec. 30, 2003, in the name of the inventors David R. Hall, et al.

U.S. Provisional Application Ser. No. 60/521,299, entitled "Wear Sensor", and filed on Mar. 29, 2004, in the name of the inventors Marcel Boucher, et al.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. An apparatus, comprising:

a bit;

a plurality of transducers situated on the bit; and an analog multiplexer situated on the bit to receive analog outputs of the transducers, multiplexing the received outputs, and transmitting a multiplexed analog output.

2. The apparatus of claim 1, wherein the bit comprises a roller cone bit or a fixed cutter bit.

3. The apparatus of claim 1, wherein the transducers represent a single type of transducer.

4. The apparatus of claim 3, wherein the single type of transducer is one of a temperature transducer, a strain gauge, an accelerometer, a pressure transducer, a directional transducer, and a wear sensor.

5. The apparatus of claim 1, wherein the transducers represent a plurality of types of transducers.

6. The apparatus of claim 3, wherein the plurality of types of transducer includes at least one of a temperature transducer, a strain gauge, an accelerometer, a pressure transducer, a directional transducer, and a wear sensor.

7. The apparatus of claim 1, further comprising at least one of:

a filter capable of filtering the analog output of the transducers;

a power circuit providing a power signal to at least one of the multiplexer and at least one of the transducers;

a timing circuit capable of providing a timing signal to at least one of the multiplexer and at least one of the transducers; and transmission circuitry for conditioning the multiplexed data for transmission uphole.

8. The apparatus of claim 1, further comprising:

a second plurality of transducers situated on the bit; and a second analog multiplexer situated on the on the bit and capable of receiving the output of the second plurality of transducers, multiplexing the received outputs of the second plurality of transducers, and transmitting the multiplexed outputs of the second plurality of transducers.

9. The apparatus of claim 8, further comprising a third multiplexer receiving the outputs of the first and second multiplexers, multiplexing the received outputs of first and second multiplexers, and transmitting the multiplexed outputs of the first and second multiplexers.

10. An apparatus, comprising:

means for boring through a subsurface formation;

means for sensing at least one down-hole drilling condition situated on the boring means and means for outputting multiple analog signals; and means for multiplexing the analog signals in an analog form and transmitting the multiplexed analog signals, the multiplexing means being situated on the boring means.

11. The apparatus of claim 10, wherein the boring means comprises a bit.

12. The apparatus of claim 11, wherein the bit comprises a roller cone bit or a fixed cutter bit.

13. The apparatus of claim 10, wherein the sensing means comprises a plurality of transducers.

14. The apparatus of claim 13, wherein the transducers represent a single type of transducer.

15. The apparatus of claim 14, wherein the single type of transducer is one of a temperature transducer, a strain gauge, an accelerometer, a pressure transducer, a directional transducer, and a wear sensor.

16. The apparatus of claim 10, wherein the sensing means comprises a plurality of types of transducers.

17. The apparatus of claim 14, wherein the plurality of types of transducer includes at least one of a temperature transducer, a strain gauge, an accelerometer, a pressure transducer, a directional transducer, and a wear sensor.

18. The apparatus of claim 10, further comprising at least one of:

means for filtering the analog output of the sensing means;

means for powering at least one of the multiplexing means and the sensing means;

means for providing a timing signal to at least one of the multiplexing means and the sensing means; and means for conditioning the multiplexed data for transmission uphole.

19. The apparatus of claim 10, further comprising:

second means for sensing at least one down-hole drilling condition situated on the boring means and capable of outputting multiple analog signals; and second means for multiplexing the analog signals of the second sensing means in an analog form and transmitting the multiplexed signals of the of the second sensing means, the second multiplexing means being situated on the boring means.

20. The apparatus of claim 19, further comprising third means for multiplexing the outputs of the first and second multiplexing means and transmitting the multiplexed outputs of the first and second multiplexing means.

21. A method, comprising:

taking a plurality of measurements of at least one down-hole drilling condition at a bit of a drill string;

generating a plurality of analog signals representative of the measurements;

analog multiplexing the analog signals at the bit; and transmitting a multiplexed analog output uphole.

22. The method of claim 21, wherein taking the plurality of measurements of at least one down-hole drilling condition includes sensing at least one of a temperature, strain on the bit, an acceleration of the bit, a pressure in the borehole, a direction of the bit, and wear on the bit.

23. The method of claim 21, further comprising:

taking a second plurality of measurements of at least one down-hole drilling condition at the bit;

generating a second plurality of analog signals representative of the second plurality of measurements; and multiplexing the second plurality of analog signals at the bit.

24. The method of claim 23, further comprising transmitting the multiplexed second plurality of analog signals uphole.

25. The method of claim 23, further comprising multiplexing the first and second multiplexed pluralities of analog signals.

26. The method of claim 25, further comprising transmitting the first and second multiplexed pluralities of analog signals uphole.

27. An apparatus, comprising:

means for taking a plurality of measurements of at least one down-hole drilling condition at a bit of a drill string;

means for generating a plurality of analog signals representative of the measurements; and means for analog multiplexing the analog signals at the bit for analog transmission.

28. The apparatus of claim 27, further comprising means for transmitting the multiplexed analog signals uphole.

29. The apparatus of claim 27, wherein means for taking a plurality of measurements the means for taking a plurality of measurements includes means for sensing at least one of a temperature, strain on the bit, an acceleration of the bit, a pressure in the borehole, a direction of the bit, and wear on the bit.

30. The apparatus of claim 27, further comprising:

means for taking a second plurality of measurements of at least one down-hole drilling condition at the bit;

means for generating a second plurality of analog signals representative of the second plurality of measurements; and means for analog multiplexing the second plurality of analog signals at the bit.

31. The apparatus of claim 30, further comprising means for transmitting the multiplexed second plurality of analog signals for analog transmission uphole.

32. The apparatus of claim 30, further comprising means for analog multiplexing the first and second multiplexed pluralities of analog signals.

33. The apparatus of claim 32, further comprising means for analog transmitting the first and second multiplexed pluralities of analog signals uphole.

* * * * *